US009153855B2

(12) United States Patent
Yamaguchi et al.

(10) Patent No.: US 9,153,855 B2
(45) Date of Patent: Oct. 6, 2015

(54) ANTENNA, ANTENNA UNIT, AND COMMUNICATION DEVICE USING THEM

(75) Inventors: Shuichiro Yamaguchi, Miyazaki (JP); Kouichi Nakamura, Miyazaki (JP); Munenori Fujimura, Miyazaki (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 831 days.

(21) Appl. No.: 12/869,250

(22) Filed: Aug. 26, 2010

(65) Prior Publication Data

US 2011/0050535 A1 Mar. 3, 2011

(30) Foreign Application Priority Data

Aug. 28, 2009 (JP) ..... 2009-197844
May 21, 2010 (JP) ..... 2010-116868

(51) Int. Cl.
*H01Q 7/06* (2006.01)
*H01Q 1/22* (2006.01)

(52) U.S. Cl.
CPC ..... *H01Q 1/2283* (2013.01); *H01Q 7/06* (2013.01)

(58) Field of Classification Search
CPC ..... H01Q 1/2283; H01Q 7/06
USPC ..... 343/870, 895, 787–788
See application file for complete search history.

(56) References Cited

U.S. PATENT DOCUMENTS 5,818,398 A * 10/1998 Tsuru et al. ..... 343/895
5,973,651 A * 10/1999 Suesada et al. ..... 343/752
6,271,796 B1 8/2001 Itoh et al.
7,755,558 B2 7/2010 Ueda et al.
7,786,943 B2 8/2010 Deguchi
8,599,092 B2 * 12/2013 Washiro ..... 343/788
2002/0105479 A1 8/2002 Hamada et al.
2005/0078038 A1 4/2005 Takaki et al.
2006/0152427 A1 7/2006 Ueda et al.
2006/0192712 A1 * 8/2006 Park et al. ..... 343/700 MS
2007/0285335 A1 * 12/2007 Bungo et al. ..... 343/895
2008/0007473 A1 1/2008 Yosui et al.
2008/0036672 A1 2/2008 Ueda et al.
2009/0179812 A1 7/2009 Nakamura et al.
2010/0289708 A1 11/2010 Bungo et al.

FOREIGN PATENT DOCUMENTS

DE 19607092 8/1997
EP 1221735 7/2002

(Continued)

OTHER PUBLICATIONS

U.S. Appl. No. 12/732,580 to Futoshi Deguchi et al., filed Mar. 26, 2010.

(Continued)

*Primary Examiner* — Sue A Purvis
*Assistant Examiner* — Amal Patel
(74) *Attorney, Agent, or Firm* — Greenblum & Bernstein, P.L.C.

(57) ABSTRACT

An antenna has a base substrate, a coil formed from a conductor wound around the base substrate, and a plurality of terminals connected to the conductor. Uncovered base substrate portions where the conductor is absent are formed on the base substrate except the start and end of turns of the coil. The terminals are provided on respective sides of the coil parallel to a coil axis and on the uncovered base substrate portions.

15 Claims, 17 Drawing Sheets

(56) References Cited

FOREIGN PATENT DOCUMENTS

| | | |
|---|---|---|
| EP | 1505689 | 2/2005 |
| EP | 1703586 | 9/2006 |
| JP | 2000-348941 | 12/2000 |
| JP | 2004-159348 | 6/2004 |
| JP | 2008-048376 | 2/2008 |
| JP | 2009-182902 | 8/2009 |
| WO | 2009/104924 | 8/2009 |

OTHER PUBLICATIONS

U.S. Appl. No. 12/869,238 to Shuichiro Yamaguchi et al., filed Aug. 26, 2010.
U.S. Appl. No. 12/915,163 to Yasuki Nagatomo et al., filed Oct. 29, 2010.
Search report from E.P.O. for EP 10174332 dated Feb. 4, 2011.

* cited by examiner

ANTENNA, ANTENNA UNIT, AND COMMUNICATION DEVICE USING THEM

BACKGROUND

1. Field of the Invention

The present invention relates to an RF-ID; namely, a radio communication medium processing device that establishes communication with a radio communication medium, like an IC card and an IC tag, or an antenna and an antenna unit used in the radio communication medium itself, as well as to a communication device using the antenna and the antenna unit.

2. Background Art

Portable terminals, such as portable phones, equipped with built-in RF-ID radio tags or a function of reading a non-contact IC card or an IC tag have recently become proliferated. Antenna units that each include a magnetic sheet affixed to an aperture area of a loop antenna (a coil axis of the loop antenna is perpendicular to the magnetic sheet) are frequently used.

Patent Document 1: JP-A-2009-182902

In order to attach a related art antenna, it is necessary to secure a location, in a portable terminal, that is substantially equal in area to the antenna. This has become a factor for hindering a reduction in the size and thickness of the portable terminal.

SUMMARY

Accordingly, the present invention aims at providing an antenna and an antenna unit that enable realization of space saving and that exhibit superior communication performance.

The present invention provides an antenna comprising: a base substrate; a coil formed from a conductor wound around the base substrate; and a plurality of terminals connected to the conductor, wherein uncovered base substrate portions where the conductor is absent are formed on the base substrate except a start and end of turns of the coil; and the terminals are provided on respective faces of the coil parallel to a coil axis and on the uncovered base substrate portions.

The present invention makes it possible to provide an antenna and an antenna unit that enable realization of space saving and that exhibit superior antenna performance, as well as to provide a communication device using them.

DETAILED DESCRIPTION

Figure 1:
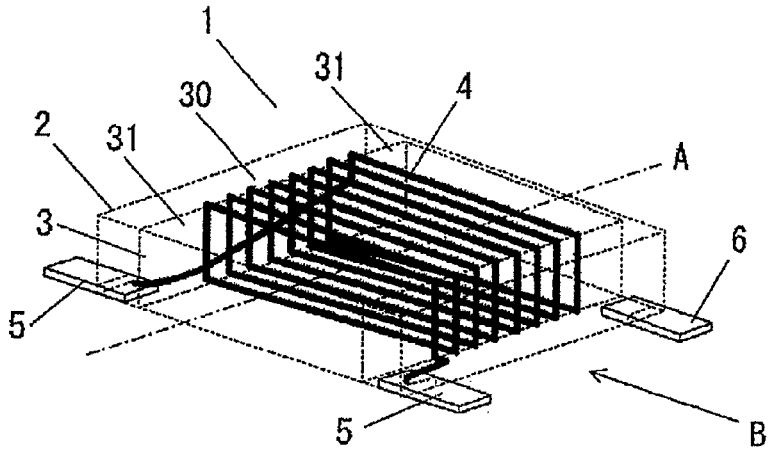
FIG. 1 is an oblique perspective view of an antenna of an embodiment of the present invention.

According to the present invention, it is possible to provide an antenna including a base substrate; a coil formed from a conductor wound around the base substrate; and a plurality of terminals connected to the conductor. Uncovered base substrate portions where the conductor is absent are formed on the base substrate except the start and end of turns of the coil. The terminals are provided on the respective sides of the coil parallel to a coil axis and on the uncovered base substrate portions. It is thereby possible to provide an antenna and an antenna unit, which enable space saving and which exhibit superior communication performance, and a communication device using them.

Further, it is preferable that the number of turns of the coil of the antenna is larger than an integral multiple by substantially one-half of the turn, because the antenna can efficiently utilize the electric current flowing over the metallic element on which the antenna is to be mounted.

Moreover, the uncovered base substrate portion is formed on each end of the base substrate, whereby a magnetic field passing through an interior of the coil is made substantially parallel to the coil axis, so that an electric current can efficiently be guided.

The plurality of terminals connected to the coil are on the same uncovered base substrate portion. As a result, it is thereby possible to provide an antenna and an antenna unit, which enable space saving and which exhibit superior communication performance, and a communication device using them.

The terminals each are placed at substantial four corners of the coil. The conductor is connected to the terminals, among the four terminals, placed on both sides of the base substrate with its coil axis interposed therebetween. It is thereby possible to provide an antenna and an antenna unit, which enable space saving and which exhibit superior communication performance, and a communication device using them.

An imaginary straight line passing through the two terminals connected to the conductor is substantially parallel to the winding direction of the coil. The magnetic field passing through the interior of the coil can thereby be made substantially parallel to the coil axis, so that an electric current can efficiently be guided.

Moreover, the imaginary straight line passing through the two terminals connected to the conductor is substantially parallel to a diagonal line of the base substrate. As a result, it is thereby possible to acquire an antenna unit that enables efficient utilization of the electric current flowing over the metallic element and that exhibits superior communication performance.

The plurality of terminals connected to the conductor are placed on both sides of the base substrate with its coil axis interposed therebetween. The imaginary straight line passing through the two terminals connected to the conductor is substantially parallel to the winding direction of the coil. As a result, it is thereby possible to acquire an antenna unit that enables efficient utilization of the electric current flowing over the metallic element and that exhibits superior communication performance.

The plurality of terminals to which the conductor is to be connected are provided on both sides of the base substrate with the coil axis interposed therebetween. An imaginary straight line passing through the two terminals to which the conductor is to be connected is substantially parallel to a diagonal line of the base substrate. As a result, it is thereby possible to acquire an antenna unit that enables efficient utilization of the electric current flowing over the metallic element and that exhibits superior communication performance.

The antenna is mounted such that at least one of the uncovered base substrate portions provided on the antenna is situated outside of the outer periphery of the metallic element on which the antenna is mounted. As a result, it is thereby possible to acquire an antenna unit that enables efficient utilization of the electric current flowing over the metallic element and that exhibits superior communication performance.

It is preferable that the coil is arranged in such a way that the winding direction of the coil and the ends of the base substrate that is a metallic element become parallel to each other, because the electric current flowing over the metallic element on which the antenna is mounted can efficiently be utilized.

Furthermore, it is preferable that the coil is arranged such that the winding direction of the coil and the flow of the electric current flowing through the metallic element become parallel to each other, because the electric current flowing over the metallic element on which the antenna is mounted can efficiently be utilized.

The plurality of terminals each are placed at substantially four corners of the coil. Of the four terminals, two pairs of terminals, each of which consists of two terminals placed in the vicinity of the two corners situated along one side of the base substrate, each are joined together by means of the joints provided along the respective sides of the base substrate. It is thereby possible to acquire an antenna unit that does not require an excessive length for the coil and that is not limited in terms of directivity when mounted on the communication device.

The terminals act as fixing portions when the antenna unit is mounted, whereby the antenna unit can stably be placed in a communication device, or the like.

The joints extend substantially parallel to the coil axis of the base substrate. It is thereby possible to easily acquire an antenna unit that does not require an excessive length for the coil and that is not limited in terms of directivity when mounted on a communication device.

Embodiment

An embodiment of the present invention is hereunder described by reference to the drawings.

FIG. 1 is an oblique perspective view of an antenna of an embodiment of the present invention.

An antenna 1 is configured in the following manner. Namely, a conductor 4 is wound around a base substrate 3, thereby making up a coil 30. The coil 30 is covered with a protective material 2 and is also provided with terminals 5 connected to the conductor 4 and fixing terminals 6 that are not connected to the conductor 4 and that are intended for enhancing vibration resistance and packing strength.

The terminals 5 are provided on respective surface sides of the coil 30 parallel to a coil axis A and within an uncovered base substrate portion 31 not provided with the coil 30.

Detailed descriptions are provided for a layout of the terminals 5. In the present embodiment, the terminals 5 are provided on the respective surface sides of the coil 30 parallel to the coil axis A. When viewed in a direction B perpendicular to the surfaces provided with the terminals 5, at least one of the input/output terminals 5 is situated within a plane of the uncovered base substrate portion 31. Namely, when viewed in the direction B, at least one of the terminals 5 overlaps a surface of the uncovered base substrate portion 31.

All you have to do is to place the terminals 5 on the surface sides parallel to the coil axis A and in the vicinity of the uncovered base substrate portion 31; namely, an area around the coil 30 or an area around the uncovered base substrate portion 31 exclusive of a surface perpendicular to the coil axis A. It is not necessary to place the terminals 5 in such a way that at least one of the terminals 5 overlaps the surface of the uncovered base substrate portion 31 when viewed in the direction B, as in the case with the present embodiment.

It is preferable to use a magnetic substance, such as ferrite, for the base substrate 3, whereby a magnetic flux passing through the coil 30 increases, to thus enable enhancement of communication performance. However, the base substrate 3 is not limited to a magnetic substance and can also be formed from; for instance, ceramic, a resin, and the like.

It is preferable to use a wire such as a sheathed copper wire or tape-shaped or ribbon-shaped metal such as narrow copper foil for the conductor 4. However, there may also be adopted a method for affixing metal to a surface of a magnetic core 3 by means of plating or evaporation so as to leave necessary areas intact, to thus form the coil 30.

It is also preferable to form the terminals 5 by punching or bending an alloy formed from copper and iron, or the like. Further, it is also preferable to plate surfaces of the terminals 5 with metal, such as zinc, so that the surfaces can readily be soldered.

The fixing terminals 6 are also formed in the same manner as are the input/output terminals 5. However, the fixing terminals 6 may be omitted according to the size and usage of the antenna 1. Further, the fixing terminals 6 can also be provided in any numbers.

Further, a mold like an epoxy resin, a tape, and paint, and others, are used for the protective material 2. The protective material 2 can be given objectives of preventing breaking of wire of the conductor 4, breakage of the base substrate 3, and forming a suction block for use in an automatic mounting machine, and others. Moreover, in order to prevent erroneous printing of a mark and a part number of an input/output pin on a top surface of the antenna 1, the protective material 2 is preferable. Although the antenna has a configuration involving use of the protective material 2 in the present embodiment, the protective material 2 may also be omitted.

In FIG. 1, the coil 30 is wound about 7.5 turns; namely, the number of turns is larger than an integral multiple by about a one-half of turn. Therefore, input and output terminals are placed with the coil 30 sandwiched therebetween. This is preferable because, when a plurality of antennas are connected and when an antenna is inserted into a portion of a loop conductor, the terminals 5 are placed on both sides of the antenna 1, which facilitates wiring.

In FIG. 1, the terminals 5 are situated on a lower side of the antenna 1 when the antenna 1 is connected to a board. Further, the number of turns of the conductor 4 is set to 7.5 turns. Hence, the number of turns of the conductor 4 wound around the upper surface of the base substrate 3 is greater than the number of turns of the conductor 4 wound around the lower surface of the same.

The reason for this is that, when the antenna 1 is mounted on a metallic element, the conductor 4 on the lower surface of the antenna 1 becomes close to the metallic element and is susceptible to a magnetic field developing from an eddy current of the metallic element in a direction of canceling a signal. The conductor 4 on the upper surface of the same, however, is less susceptible to the magnetic field. Hence, a characteristic of the coil 30 is improved when the number of turns of the conductor 4 on the upper surface less susceptible to the eddy current becomes greater.

Figure 2:
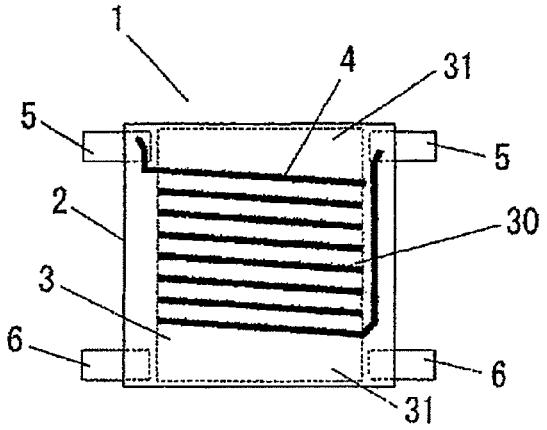
FIG. 2 is a plan view of the antenna of the embodiment of the present invention.

FIG. 2 is a plan view of the antenna of the embodiment of the present invention.

A characteristic of the present invention lies in that the terminals 5 connected to the conductor 4 are situated along the uncovered base substrate portion 31. In the antenna shown in FIG. 2, the fixing terminals 6 are provided along another uncovered base substrate portion 31 as in the case with the terminals 5. However, the locations of the fixing terminals 6 are not particularly limited.

The uncovered base substrate portion shown in FIG. 1 designates an area on the base substrate 3 where the conductor 4 is not provided rather than the coil 30 where the conductor 4 is tightly wound around the base substrate.

In the present embodiment, the uncovered base substrate portions 31 are provided on the respective ends of the base substrate 3. However, the arrangement is preferable because, for instance, when a magnetic field comes from the outside, it becomes possible to make the magnetic field passing through an interior of the coil 30 more parallel to the coil axis by means of such a layout, thereby increasing an electric current induced by the coil 30. Further, the two terminals 5 are placed within a plane of the same uncovered base substrate portion 31. It thereby becomes possible to achieve a layout exhibiting the highest performance when the antenna 1 is mounted on a metallic element. An overall geometry of the antenna is substantially square; however, the geometry is not limited to square.

Figure 3:
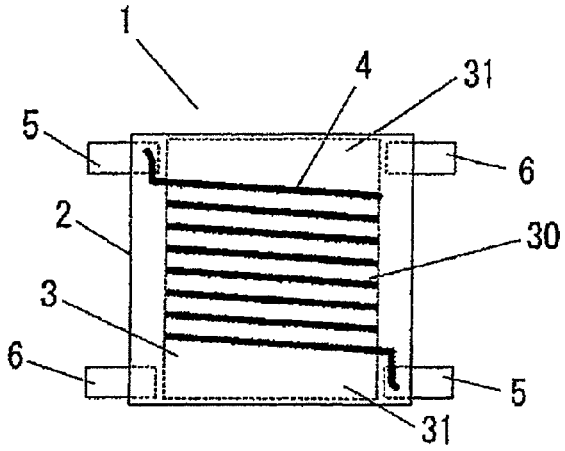
FIG. 3 is a plan view of another antenna of the embodiment of the present invention.

FIG. 3 is a plan view of another antenna of the embodiment of the present invention.

The antenna differs from the antenna shown in FIG. 2 in terms of the positions of the terminals 5. The terminals 5 are placed along a diagonal line. When such an antenna 1 is mounted on a metallic element, the antenna becomes slightly inferior in performance to the antenna shown in FIG. 1. However, since the inferiority does not exert any substantial influence, a terminal layout, such as that described in connection with the present embodiment, can be selected according to situations in which the antenna is used.

Figure 24:
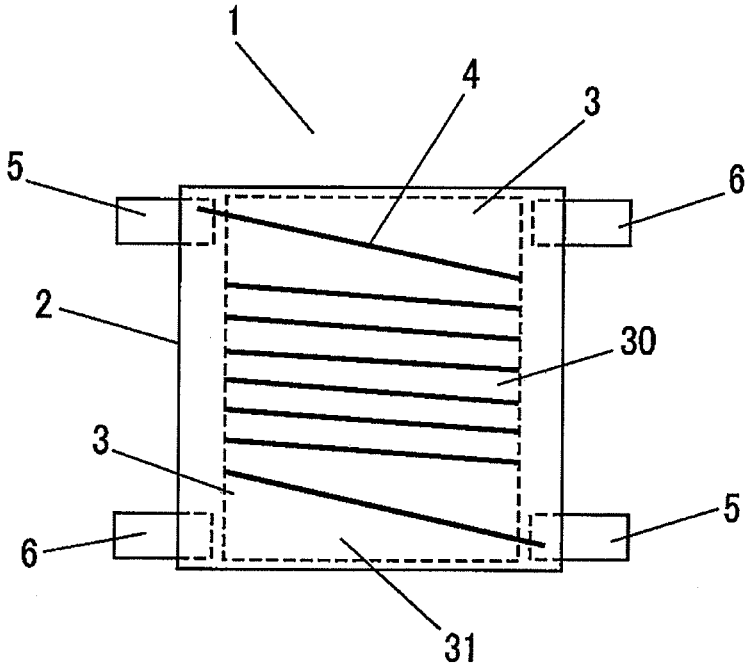
FIG. 24 is a plan view of still another antenna of the embodiment of the present invention.

FIG. 24 is a plan view of still another antenna of the embodiment of the present invention.

In FIG. 24, a start and end of a turn of the conductor 4 are oblique, and the conductor 4 is present in the uncovered base substrate portions 31. Since the uncovered base substrate portions 31 of the present invention are defined as areas that are exclusive of the start and end of the turn and where the conductor 4 is not present. Therefore, the antenna shown in FIG. 24 also falls within the scope of the present invention. The start and end of the turn is considered to be approximately one-half of turn.

When the antenna of the present invention is placed on the metallic element, the following advantages are yielded, as a result of the uncovered base substrate portions being provided, when the uncovered base substrate portions are placed in the interior of the metallic element and when the uncovered base substrate portions are placed at ends of the metallic element.

When the uncovered base substrate portions are placed in the interior of the metallic element in a case where a magnetic substance is used as the base substrate, a magnetic field developing in the interior of the coil becomes more parallel to a coil axis than a case where the uncovered base substrate portions are not provided. Therefore, transmission and receiving operations can efficiently be performed, so that an efficiency of the antenna can be enhanced.

Further, when the uncovered base substrate portions are placed on an exterior of the metallic element and when an antenna having terminals connected to both ends of the uncovered base substrate portions is used, the antenna can be made efficient by means of a minimum number of coil turns.

When the coil is wound up to both ends of the base substrate without use of the uncovered base substrate portions as in the case with the related art, the coil situated outside of the metallic element cannot capture the magnetic field on the metallic element induced by an electric current; hence, the coil does not contribute to the antenna characteristic or efficiency. When the base substrate does not protrude from the metallic element and when the coil is wound up to both ends of the base substrate, the magnetic field developing in the coil in the vicinity of the ends of the base substrate does not become parallel to the coil axis even when the base substrate is a magnetic substance, so that the antenna characteristic is deteriorated.

For these reasons, in the present embodiment, the uncovered base substrate portions are provided on both sides of the antenna in order to enhance the antenna characteristic.

Figure 4:
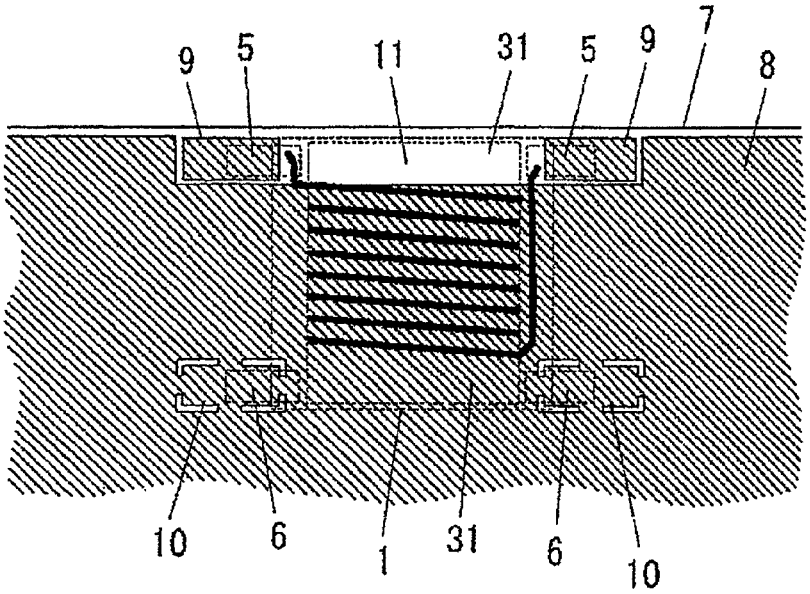
FIG. 4 is a schematic diagram of a first antenna unit using the antenna of the embodiment of the present invention.

FIG. 4 is a schematic diagram of a first antenna unit using the antenna of the embodiment of the present invention, showing a configuration achieved when the antenna 1 shown in FIG. 2 is mounted on a substrate 7. Since ends of the substrate 7 are illustrated in an enlarged manner, right, left, and lower portions of the substrate 7 are not illustrated.

A ground pullout portion 11 not having a conductor is provided along an outer periphery of a conductor pattern 8 forming a ground, and input/output terminal lands 9 are provided along the outer periphery such that the uncovered base substrate portions 31 of the antenna 1 and the terminals 5 are situated.

A length of the uncovered base substrate portions achieved in the direction of the coil axis is substantially identical with a length of the ground pullout portion 11.

The conductor pattern 8 is further provided with fixing terminal lands 10 for securing the fixing terminals 6, and the fixing terminal lands are electrically connected to the conductor pattern 8.

In view of performance, it is preferable that a ground electrode which is an interior layer of the substrate should not be present in the ground pullout portion 11. However, when the substrate 7 is thick, or the like, there can also be adopted a configuration in which the ground pullout portion 11 is provided in only a layer in proximity to the antenna 1.

A glass epoxy base material, or the like, is usually used for the substrate 7, and copper is often used for the conductor pattern 8. However, the substrate and the conductor pattern are not limited to these materials, and other materials can also be used. A surface of the substrate is usually provided with a solder resist, a silk screen print, and others. Further, the conductor pattern 8 is assumed to be a ground in the present embodiment, but a pattern raised from the ground may also be used. At this time, it is better for the conductor pattern to have a larger area. For example, when a magnetic field is exerted on the antenna from the outside, an eddy current developing in the conductor pattern becomes large, with the result that communication performance is improved.

Although FIG. 4 shows an embodiment in which the antenna 1 is mounted on the substrate 7, a location where the antenna is to be mounted is not limited to the substrate. For instance, the antenna can also be mounted on a metallic element, such as a battery frame and a liquid crystal panel frame. As a result of adoption of the configuration such as that shown in FIG. 4, the coil 30 can utilize an area on the conductor pattern 8 where the highest current density appears, so that the performance of the antenna 1 can consequently be made best.

Figure 5:
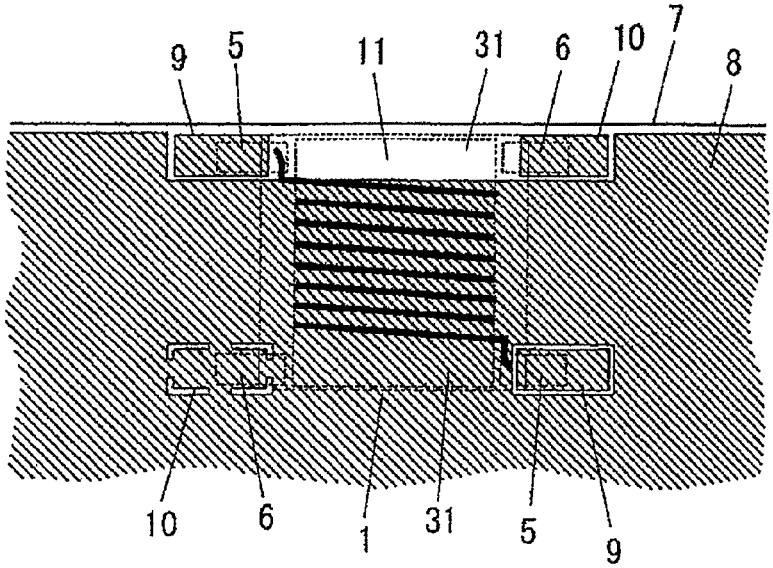
FIG. 5 is a schematic diagram of the antenna unit using another antenna of the embodiment of the present invention.

FIG. 5 is a schematic diagram of an antenna unit using another antenna of the embodiment of the present invention, showing a configuration in which the antenna shown in FIG. 3 is mounted on the substrate 7. The ground pullout portion 11 not having a conductor is provided along the outer periphery of the conductor pattern 8 forming the ground. The input/output terminal land 9 and the fixing terminal land 10 are provided such that the uncovered base substrate portions 31, the terminals 5, and the fixing terminals 6 of the antenna 1 are situated in the ground pullout portion. The other input/output terminal land 9 and the other fixing terminal land 10 are provided in the conductor pattern 8. By means of such a configuration, the coil 30 can utilize the area on the conductor pattern 8 where the highest current density appears. Hence, superior communication performance that is slightly inferior to that achieved by the configuration shown in FIG. 4 can be obtained.

Figure 6:
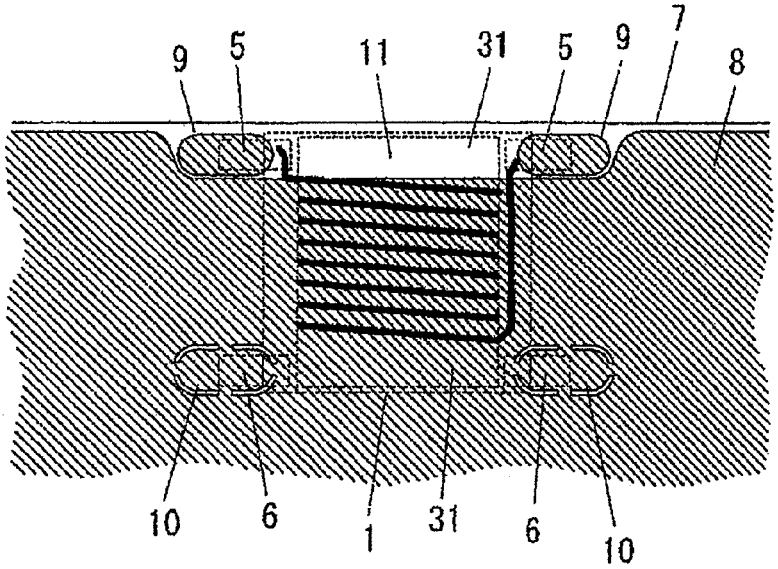
FIG. 6 is a schematic diagram of a second antenna unit using the antenna of the embodiment of the present invention.

FIG. 6 is a schematic diagram of a second antenna unit using the antenna of the embodiment of the present invention. Although having a similar layout, the antenna unit is different from the antenna unit shown in FIG. 4 in terms of a shape of the ground pullout portion 11, a shape of the input/output terminal land 9, and a shape of the fixing terminal land 10. It is preferable to round edges of the pattern as shown in FIG. 6, because occurrence of a loss, which would otherwise arise when the electric current flowing along a surrounding of the outer periphery of the conductor pattern 8 concentrates on the edges, can be avoided. Although the terminal layout achieved when the terminals are provided in the antenna shown in FIG. 2 is illustrated, the terminal layout is not limited to the illustrated layout.

Figure 7:
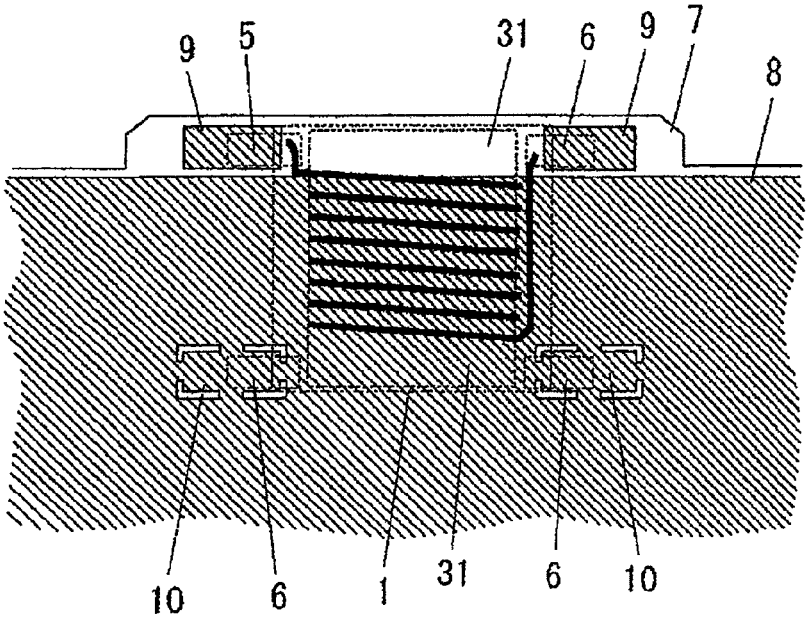
FIG. 7 is a schematic diagram of a third antenna unit using the antenna of the embodiment of the present invention.

FIG. 7 is a schematic diagram of a third antenna unit using the antenna of the embodiment of the present invention. The antenna unit differs from its counterparts shown in FIGS. 4 through 6 in that the input/output terminal lands 9 are made such that one uncovered base substrate portion 31 is arranged outside of the outer periphery of the conductor pattern 8 rather than the ground pullout portion 11 being provided below one uncovered base substrate portion 31. Even the configuration makes it possible for the coil 31 to utilize an area on the conductor pattern 8 where the highest current density develops, so that superior communication performance can be acquired. Although the terminal layout achieved when the terminals are provided in the antenna shown in FIG. 2 is illustrated, the terminal layout is not limited to the illustrated layout. The similar layout can also be acquired even in the case of the antenna shown in FIG. 3.

Although a signal line to the input/output terminal lands 9 is not illustrated in FIGS. 4 through 7, it is preferable to route a line so as to run through an interior layer or a back side of the substrate 7, because the line does not hinder the electric current flowing through the conductor pattern 8. Moreover, the fixing terminal lands 10 may or may not be connected to the conductor pattern 8.

When the antenna 1 is mounted on a metallic element that is not a substrate, difficulty is considered to be encountered in performing reflow mounting operation. In this case, the antenna 1 is fixed to a predetermined position by means of a double-sided table, or the like. Power can be fed to the terminals 5 by means of physical contact of a pin, soldering of a wire, or the like. Hence, an antenna unit exhibiting superior communication performance can be provided in the same manner as in the case where the antenna is mounted on the substrate.

Explanations are now given to a concept that the antenna 1 of the present invention provided on a metallic element through surface mounting acts as an antenna in a direction perpendicular to the plane of the metallic element.

Figure 8:
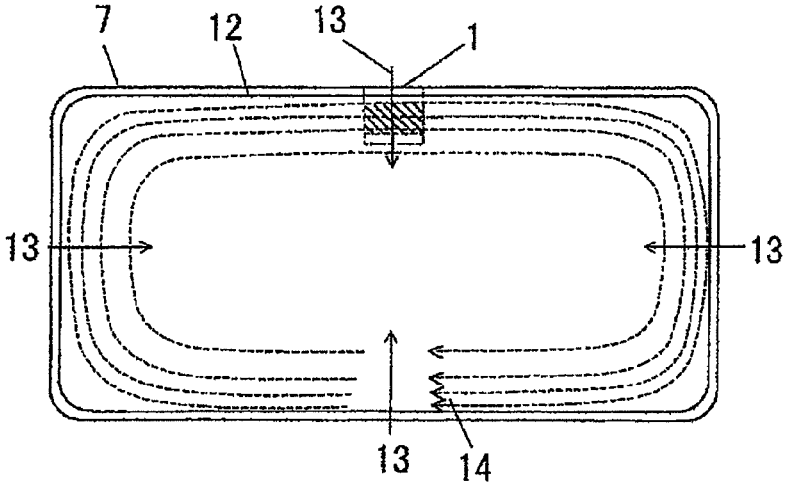
FIG. 8 is a conceptual rendering of the present invention.

FIG. 8 is a conceptual rendering of the present invention. The drawing illustrates that the antenna 1 of the present invention is mounted on the substrate 7 such that uncovered base substrate portions are situated outside of a conductor pattern outer periphery 12.

First, explanations are provided to a case where a signal is input to the antenna 1. When a signal is input to the antenna 1, an electric current flows into a coil of the antenna 1, and the electric current induces a magnetic field in a direction of a coil axis of the coil. Specifically, if the antenna is continually held in this state, the antenna stays orthogonal to the magnetic field perpendicular to the substrate 7, and hence the antenna cannot act as an antenna. The magnetic field induces, in the substrate 7, an electric current 14 that generates a magnetic field 13 in a direction of cancelling the magnetic field of the antenna 1. The electric current 14 flows along the conductor pattern outer periphery 12 and exhibits the highest current density at the outer periphery and a smaller current density with an increasing distance toward the interior of the substrate. Since the electric current 14 flowing along the conductor pattern outer periphery 12 forms a large loop path, a magnetic field thereby develops in a direction perpendicular to a principal plane of the substrate 7. Therefore, it is seen that the antenna 1 becomes an antenna exhibiting superior performance in a direction perpendicular to the principal surface of the substrate 7.

By reference to FIG. 8, explanations are now provided to a case where a magnetic field is exerted on, in a direction perpendicular to, the substrate 7 from the outside. When an external magnetic field perpendicular to the principal plane of the substrate 7 is exerted, the electric current (eddy current) 14 that induces a magnetic field in a direction of cancelling the external magnetic field develops in the substrate 7. The magnetic field 13 caused by the electric current 14 induces an electric current in the antenna 1, and the electric current is output as a signal. Consequently, the antenna 1 is understood to become an antenna that exhibits superior performance with respect to the external magnetic field in the direction perpendicular to the principal surface of the substrate 7.

From above, the antenna 1 can be said to become an antenna that exhibits superior communication performance when mounted on a metallic element. FIG. 8 shows a conceptual rendering of a case where the antenna 1 is mounted on the substrate 7. However, a component where the antenna 1 is to be mounted is not limited to the substrate. The component can also be a metallic element, such as a battery frame, a liquid crystal panel frame, and a metallic enclosure.

Arrows provided in FIG. 8 for designating directions are used for expressing directions achieved at a certain moment. In reality, the magnetic field and the signal remain oscillating at certain frequencies; therefore, their directions become opposite in another moment.

In FIG. 8, for the sake of explanation of the concept, lands for inputting or outputting a signal to or from the antenna 1 or fixing lands are not provided on the substrate 7. In this state, there is no structure that hinders the electric current flowing over the plane of the substrate 7. However, connections between the antenna unit 1 and other components must be embodied by means of aerial wiring, or the like, which undesirably hinders miniaturization, or the like, of an entire antenna unit. When automatic mounting is considered, lands must be provided in reality. There has been a necessity for contemplating a land layout whose structure least hinders the electric current flowing over the substrate 7.

To this end, the land layout has been contemplated under the following conditions in the present embodiment.

In the antenna used for the test, rectangular parallelepiped ferrite measuring 5 mm×5 mm×0.4 mm was used for the base substrate 3; a sheathed copper line having a diameter of 0.26 mm was used as the conductor 4; and an antenna having 7.5 turns was used. At this time, the length of the coil 30 was set to 3 mm, and the uncovered base substrate portion 31 having a width of 1 mm was provided on either side of the coil.

Figure 9:
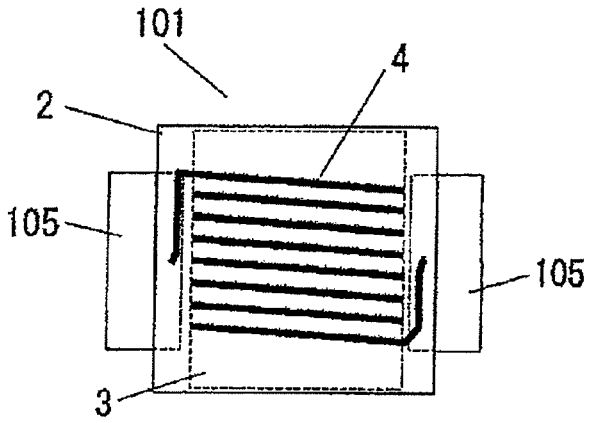
FIG. 9 is a plan view of an antenna implemented by use of an ordinary chip component configuration.

An antenna, such as that illustrated by a plan view of an antenna implemented by an ordinary chip component structure shown in FIG. 9, is presumed as an ordinary conceivable structure, and the antenna is taken as a comparative example for the present embodiment. In order to give high priority to antenna sensitivity, terminals are considered not to be provided in an opening direction of the coil of the antenna. In a chip coil, or the like, that is not so large in normal times, input/output terminals 105 assume a structure in which there are provided terminals that each have a width close to a width of the chip, as shown in FIG. 9. Since only two terminals, which are a total of input and output terminals, are provided, two terminals are considered to be suffice. There is mentioned a conceivable reason that a greater terminal width is desirable in consideration of ease of mounting operation and soldering strength.

Figure 10:
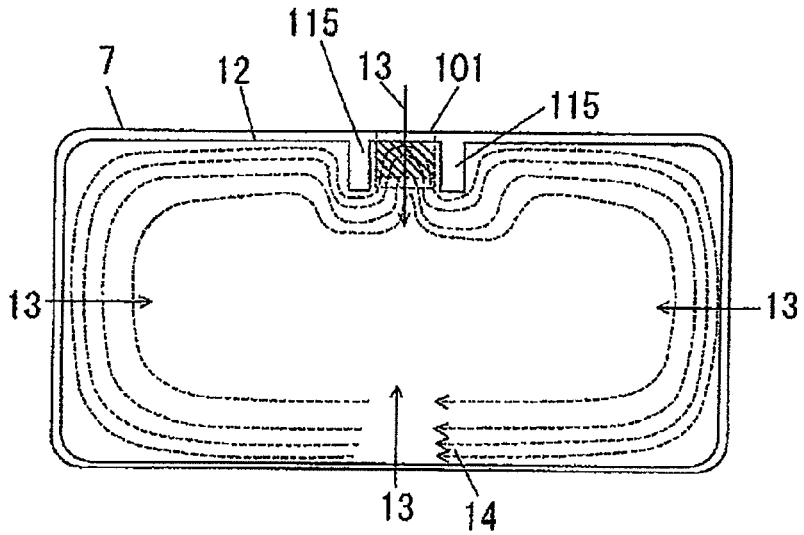
FIG. 10 is an explanatory view for Test 1.

FIG. 10 shows that an antenna 101 is mounted on the substrate 7. Since the input/output terminals 105 are provided, ground pullout portions 115 for the input/output terminals 105 are formed in the conductor pattern outer periphery 12.

For this reason, even when the substrate 7 receives a magnetic field from the outside and when the electric current has developed in the substrate 7, flow of the electric current 14 flowing over the substrate 7 is blocked by the ground pullout portions 115, to thus become meandered. A characteristic of the antenna is therefore assumed to be undesirable.

Specifically, when the conductor pattern is made as illustrated in FIG. 10 and when the antenna is arranged, an electric current flowing in a direction perpendicular to the coil axis of the antenna is small, and the antenna cannot efficiently receive the electric current flowing over the substrate 7. Therefore, the antenna characteristic is deteriorated.

This state was taken as Test 1, and the ground pullout portions 115 were made so as to measure 4 mm high×2 mm wide. In the state shown in FIG. 10, the antenna was matched to 50Ω at 13.56 MHz. A sinusoidal wave signal that exhibited a sensitivity of 20 dBm at 13.56 MHz was input from a signal generator to the antenna, and magnetic field intensity was measured at a point elevated 30 mm from the principal plane of the substrate 7. The magnetic field intensity measured at this time was taken as 100%, and Tests 2 to 7 provided below were compared.

Figure 11:
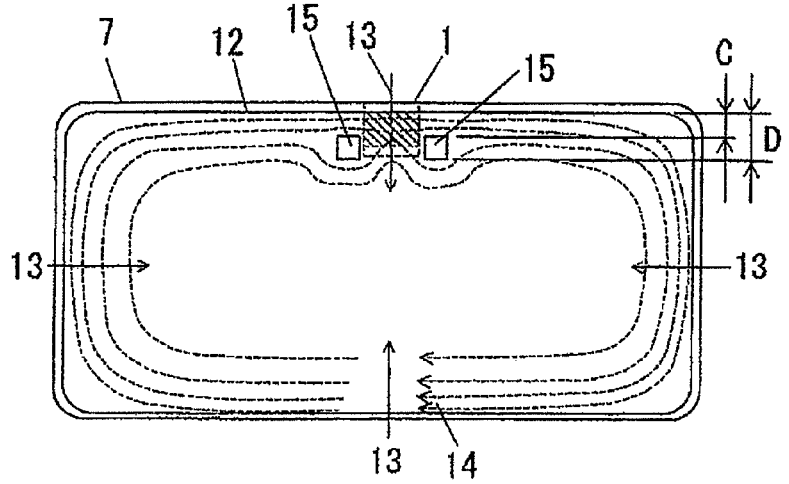
FIG. 11 is an explanatory view for Test 2 and Test 3.

FIG. 11 is a descriptive view of Tests 2 and 3. With a view toward preventing occurrence of the large meander of the electric current 14 seen in the explanatory view of Test 1 shown in FIG. 10, area C was made so as not to interrupt the conductor pattern outer periphery 12. The area C is a partial area of the conductor pattern that has a width equivalent to a distance from the conductor pattern outer periphery 12 to a ground pullout portion 15 for use in arranging input/output terminal lands. The width of the area C from the conductor pattern outer periphery toward an interior is taken as C. Reference symbol D is a distance from the conductor pattern outer periphery 12 to an inner end of the substrate of the ground pullout portion 15 for use in arranging input/output terminal lands. While the distance D was set to 4 mm, measurement was likewise conducted in the same manner as in Test 1 on condition that the width C was 1 mm for Test 2 and that the width C was 3 mm for Test 3. Test results show that the magnetic field intensity acquired in Test 2 came to 124% when compared with the magnetic field intensity acquired in Test 1 and that the magnetic field intensity acquired in Test 3 came to 131% when compared with the same. It is seen that the antenna characteristics becomes improved as the width C becomes greater.

Figure 12:
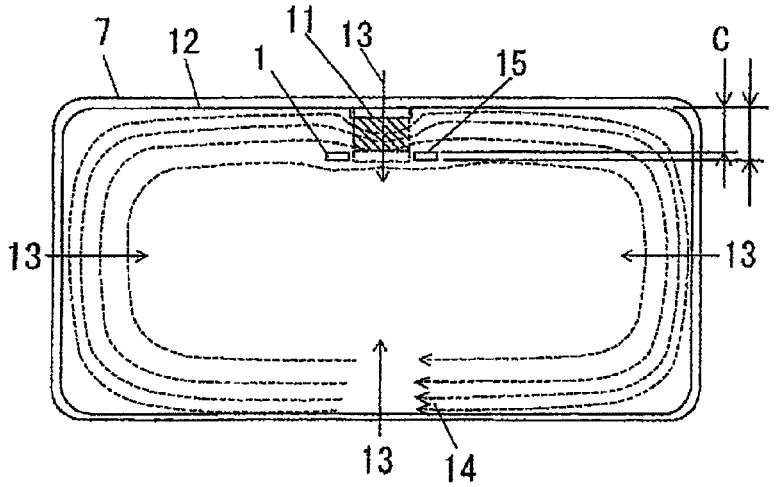
FIG. 12 is an explanatory view for Test 4.

FIG. 12 is a descriptive view of Test 4. Making a non-coil area of the antenna jut out the conductor pattern outer periphery 12 in order to increase the area C shown in FIG. 11 was terminated, and the ground pullout portion 11 was provided instead. The width C could thereby be increased to 4 mm. Further, the distance D came to 5 mm at this time. Measurement similar to that described in connection with Test 1 was carried out on the assumption that the size of the ground pullout portion 11 measured 5 mm wide×1 mm high. Consequently, the magnetic field intensity came to 124% when compared with the magnetic field intensity acquired in Test 1. A presumable reason for the measurement result being worse than that acquired in Test 3 is that a vertical edge of the ground pull out portion is close to the coil and that the electric current 14 thereby becomes partially parallel to the coil axis.

Figure 13:
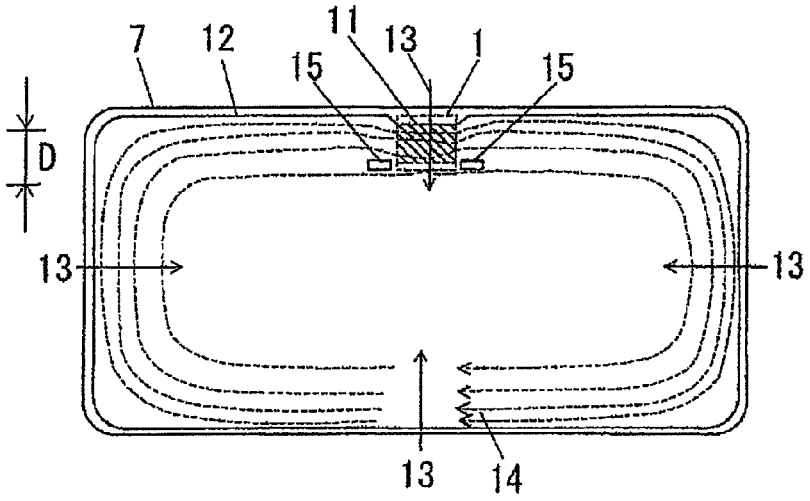
FIG. 13 is an explanatory view for Test 5.

FIG. 13 is a descriptive view of Test 5. In response to a result of Test 4, the edge of the ground pullout portion 11 was cut at an angle of 45° in order to locate the edge away from the coil. The path for the electric current 14 can thereby be made substantially perpendicular to the coil axis, so that the antenna characteristic can be presumed to be recovered. A result of measurement performed in the same manner as in the case with Test 1 shows that the magnetic field intensity was improved to 134% when compared with the magnetic field intensity acquired in Test 1.

Figure 14:
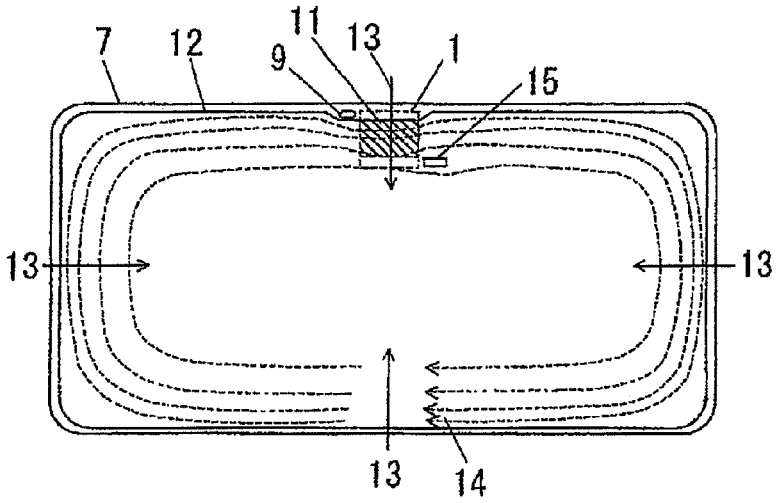
FIG. 14 is an explanatory view for Test 6.

FIG. 14 is a descriptive view of Test 6. In order to make the state of Test 5 better, there is a necessity for obviating from the path for the electric current 14 the ground pullout portions 15 for arranging the input/output terminal lands 9 that hinder the electric current 14. To this end, the ground pullout portion 11 was enlarged, and only halves of the input/output terminals placed in the path for the electric current 14 were moved to the interior of the ground pullout portion 11. One input/output terminal land 9 was placed in the ground pullout portion 11. Measurement similar to that described in connection with Test 1 was performed at this time while the ground pullout portion was still given a width of 9 mm and a height of 1 mm. A result of measurement shows that the magnetic field intensity was further improved to 138% when compared with the magnetic field intensity acquired in Test 1.

Figure 15:
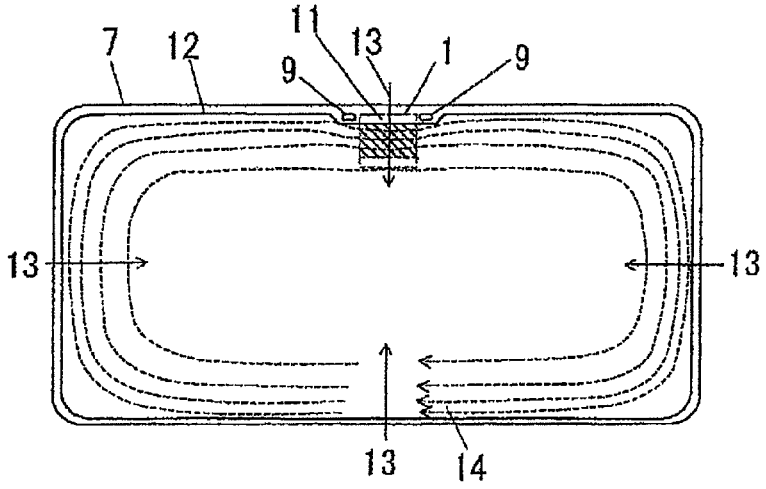
FIG. 15 is an explanatory view for Test 7.

FIG. 15 is a descriptive view of Test 7. Relocating the ground pullout portion 15 for arranging the input/output terminal lands 9 performed in Test 6 to the interior of the ground pullout portion 11 is effective. Therefore, the other ground pullout portion 15 for arranging the input/output terminal lands 9 was moved into the interior of the ground pullout portion 11, and a total of two input/output terminal lands 9 were provided in the ground pullout portion 11. Measurement similar to that described in connection with Test 1 was performed at this time while the ground pullout portion 11 was given a width of 11 mm and a height of 1 mm. A result of measurement shows that the magnetic field intensity was further improved to 145% when compared with the magnetic field intensity acquired in Test 1.

As can be seen in FIG. 8, the magnetic field intensity achieved when no lands are provided on the substrate 7 was measured by connecting a matching circuit directly to the antenna terminal, whereby a magnetic field intensity of 134% could be measured.

Figure 16:
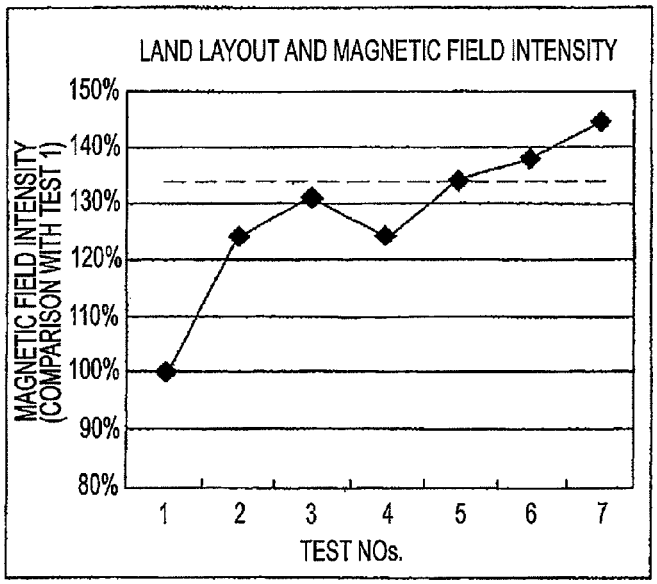
FIG. 16 is a graph showing results of Tests 1 through 7.

FIG. 16 shows a graph pertaining to the results of Tests 1 through 7. A broken line provided at a level of 134% depicts magnetic field intensity achieved in an ideal state (FIG. 8) where no lands were provided on the substrate 7. The result shows that all of the measures are effective for the antenna of the comparative example shown in FIG. 9 and that a superior communication characteristic is exhibited.

Moreover, it is understood that Test 5 (FIG. 13), Test 6 (FIG. 14), and Test 7 (FIG. 15) exhibit communication characteristics better than the communication characteristic yielded by the configuration in FIG. 8 that is an ideal state and that the communication characteristics become better than the original characteristic of the antenna 1.

A presumable reason for this is that the electric current 14 is bent along the ground pullout portion 11 as a result of the ground pullout portion 11 being provided along the conductor pattern outer periphery 12, so that the current density is increased at a position below the antenna 1; especially, a position below the coil 30. Therefore, provision of the ground pullout portion 11 and placing the uncovered base substrate portion of the antenna 1 in the ground pullout portion 11 can be said to be very effective. It is understood that the present invention is effective for providing an antenna and an antenna unit which exhibit superior communication performance.

For more comparison, similar tests were carried out by use of a sheet-like, loop antenna having a related art structure. A ferrite sheet measuring 25 mm×15 mm and having a thickness of 0.4 mm was affixed to the location of the antenna 1 shown in FIG. 8, and an antenna whose planes were provided with three turns of a sheathed copper line having a diameter of 0.26 mm and that had an exterior shape measuring 24 mm×14 mm was affixed to a position on the ferrite sheet. The magnetic field intensity of the related art antenna came to 137%. Therefore, the test shows that the antenna of the present invention can exhibit magnetic field intensity equal to or greater than the magnetic field intensity exhibited by the related art antenna by means of 7% of the area of the related art antenna (calculated in terms of the area of ferrite). Specifically, the present invention can be said to provide an antenna capable of greatly contributing to space saving.

A test conducted in relation to a winding number is now described.

Figure 17:
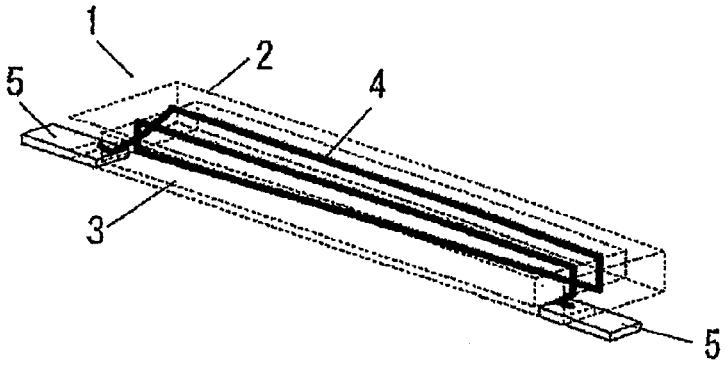
FIG. 17 is an oblique perspective view of the antenna of the embodiment of the present invention.
Figure 18:
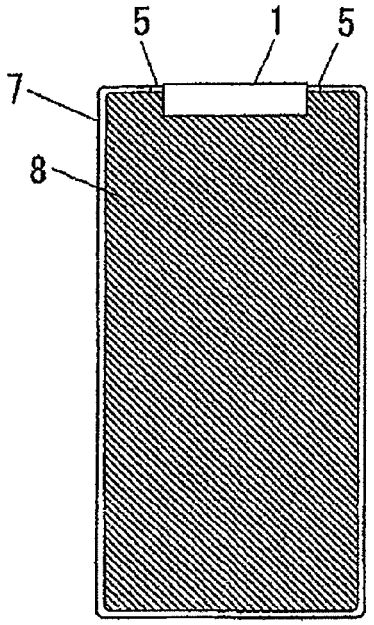
FIG. 18 is a schematic diagram of a winding number test.
Figure 19:
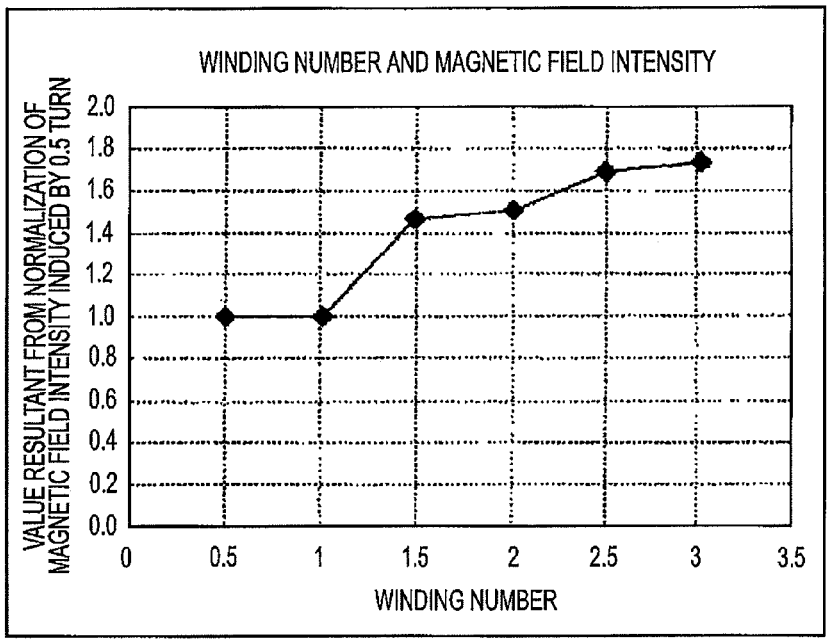
FIG. 19 is a graph showing a result of the winding number test.

FIG. 19 shows a graph of a result of a winding number test. Winding numbers are plotted along a horizontal axis, and values acquired by normalization of magnetic field intensity induced by a 0.5 turn are plotted along a vertical axis. The antenna used in the test assumes a shape, such as that shown in an oblique perspective view of the antenna shown in FIG. 17. Ferrite measuring 21 mm×4 mm×0.2 mm was used for the base substrate 3. The antennas were experimentally manufactured from a thin copper plate having a thickness of 0.1 mm while the width of the copper plate was changed from 1 mm to 0.6 mm according to the number of turns. As illustrated in the schematic diagram of FIG. 18 showing a winding number test, the antenna 1 was made close to the end of the substrate 7, and the antenna was placed such that the uncovered base substrate portion was situated outside of the conductor pattern 8. Lands were not made on the substrate 7, and the pattern was connected directly to the terminals 5. The antenna was matched to 50Ω at 13.56 MHz, and a sinusoidal wave signal that exhibited a sensitivity of 20 dBm at 13.56 MHz was input from the signal generator to the antenna, and magnetic field intensity was measured at a point elevated 30 mm from the principal plane of the metallic element. As shown in FIG. 19, the magnetic field intensity increases with an increase in winding number. An increase rate, however, shows that the magnetic field intensity greatly increases when the winding number is larger than an integral number by one-half of turn. The conductor of the coil situated on a side where the conductor does not face a metallic element 6 is less susceptible to the eddy current flowing over the surface of the metallic element 6. However, an electric current develops, in a direction of being cancelled by the eddy current flowing over the surface of the metallic element 6, in the conductor of the coil 2 situated on a side where the conductor faces the metallic element 6. Therefore, an increase in magnetic field intensity can be presumed to be small when the winding number assumes an integral number. This is effective for efficiently designing antenna from a smaller amount of material.

Explanations are now given to a case where the antenna is built in a portable terminal.

Figure 20:
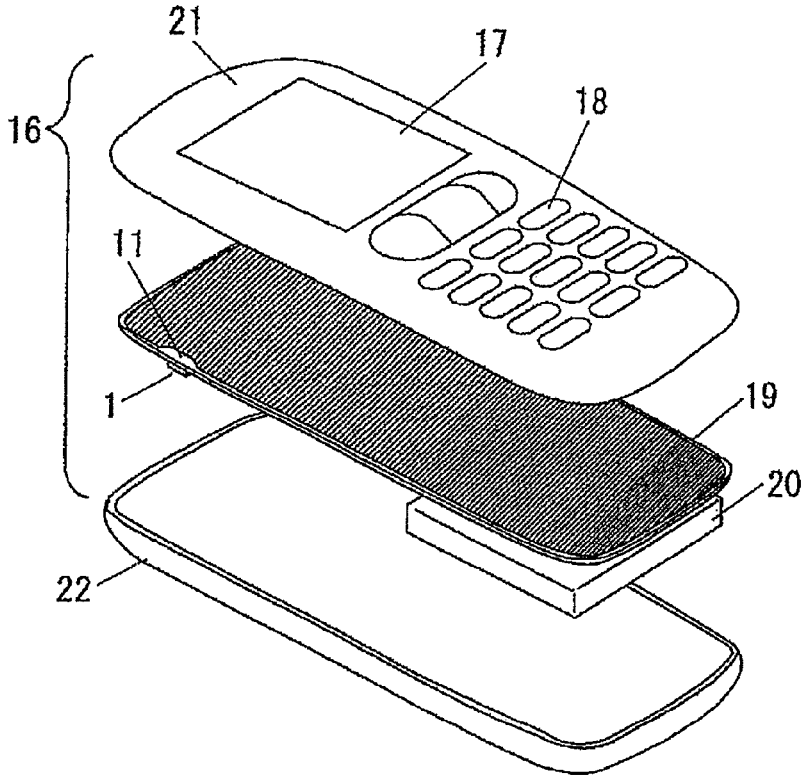
FIG. 20 is an exploded oblique perspective view of a portable terminal using the antenna of the embodiment of the present invention.
Figure 21:
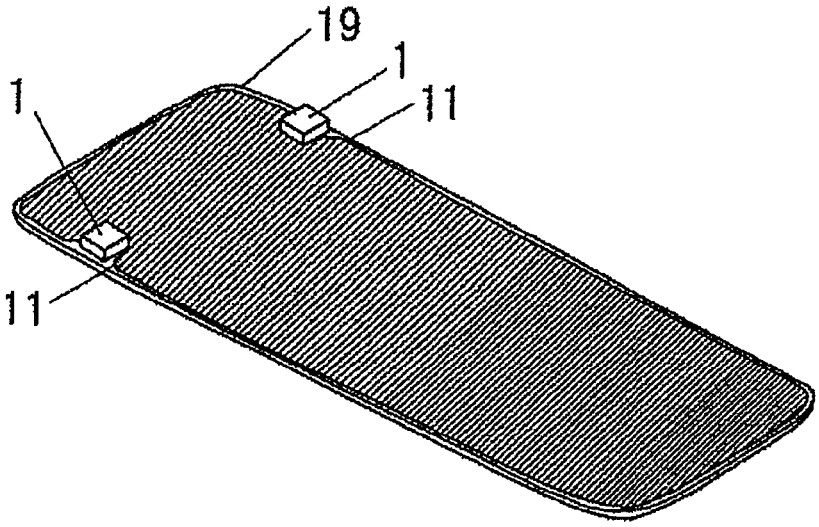
FIG. 21 is an oblique perspective view of a back side of a substrate shown in FIG. 20.

FIG. 20 is an exploded oblique perspective view of a portable terminal using the antenna of the embodiment of the present invention, and FIG. 21 is an oblique perspective view of a back side of a substrate shown in FIG. 20. A portable terminal 16 includes a liquid crystal panel 17, buttons 18, a substrate 19 and a battery 20 that are enclosed within enclosures 21 and 22, and others. The antenna 1 is attached to the substrate 19. The antenna 1 is mounted on a surface of the substrate 19 opposite to its side where the liquid crystal panel 17 is provided. The ground pullout portion 11 is formed in the substrate 19. Although unillustrated, components, such as ICs, an RF module, antennas for other frequencies, a speaker, and a camera unit, are assumed to be mounted on the substrate 19.

FIG. 21 is a view showing a back side of the substrate 19, and two antennas 1 are provided on the substrate 19. When the antenna is provided in numbers as mentioned above, the electric current flowing over the surface of the substrate can be used more efficiently than the case where one antenna is used. Therefore, use of two antennas is preferable. As a matter of course, the antennas 1 do not need to be arranged symmetrically in the horizontal direction as shown in FIG. 21, nor is the number of antennas limited to two. Best performance is exhibited when antennas are mounted at substantially center points on respective long sides of the substrate where the highest concentration of the electric current flowing over the substrate appears. However, the antennas perform their functions even when mounted at any locations, so long as they are around the substrate 19. Therefore, it is possible to produce an antenna unit without concern for footprints of antennas by mounting the antennas in unoccupied space. Moreover, when the antenna 1 is smaller in height than other components to be mounted, the antenna 1 is mounted in space between the higher mounted components, whereby the thickness of the antenna 1 does not exert any influence on a design thickness of the portable terminal. Hence, an antenna unit can be produced without involvement of an increase in thickness of a portable phone, which would otherwise be induced by use of a related art sheet-like antenna. The antennas 1 are mounted on the substrate 19 in FIG. 20. However, an antenna unit can be produced by mounting the antennas 1 on a metallic element, such as a frame of the battery 20 and a frame of the liquid crystal panel 17.

Figure 22:
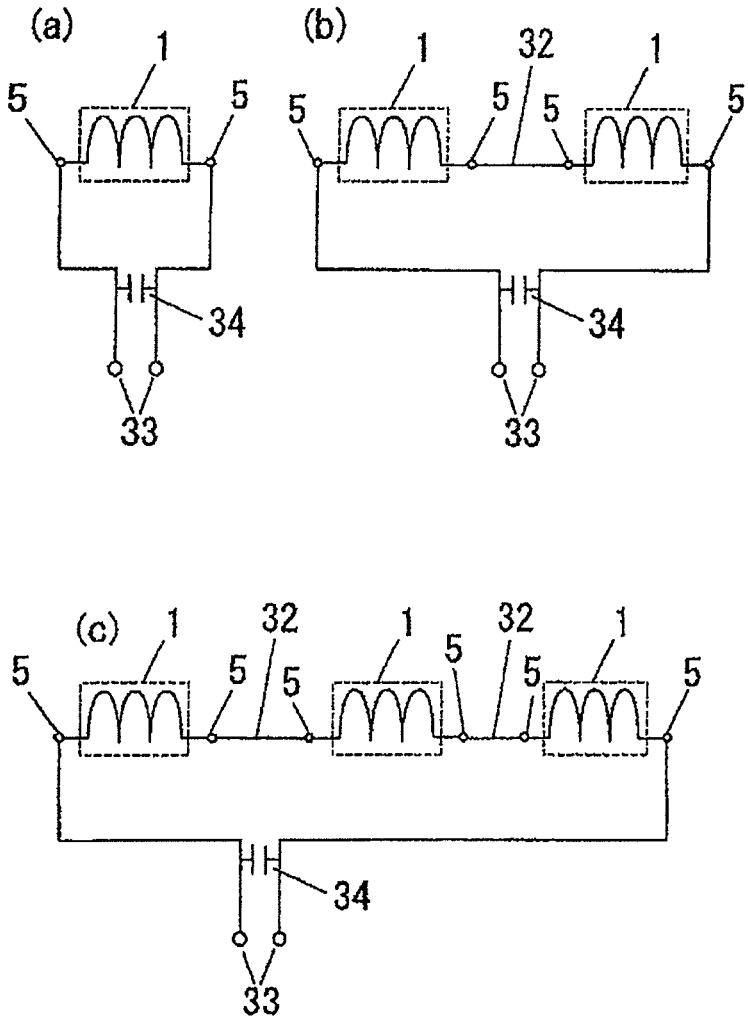
FIG. 22 is a circuit diagram of an antenna circuit of the present invention.

FIG. 22 is a circuit diagram of the antenna circuit of the present invention. FIG. 22A is a circuit diagram for a case where one antenna 1 is incorporated. FIG. 22B is a circuit diagram for a case where two antennas are mounted. FIG. 22C is a circuit diagram for a case where three antennas are used. The circuit includes the antenna(s) 1, the terminals 5, a resonance frequency control capacitor 34, and matching circuit connection terminals 33 connected to a matching circuit, an IC, or the like. When a plurality of antennas are used, the antennas 1 are interconnected by means of an interconnection conductor(s) 32, whereby the number of antennas can readily be increased. Therefore, it becomes possible to readily enhance the antenna characteristic. Capacitance of the resonance frequency control capacitor 34 is determined from inductance of the antennas 1 achieved when the antennas 1 are mounted at predetermined locations and from a frequency used. FIG. 22 shows only one resonance frequency control capacitor 34, fine control may also be enabled by use of a plurality of resonance frequency control capacitors. Moreover, the resonance frequency control capacitor 34 can also be provided in a matching circuit connected to the matching circuit connection terminals 33.

Figure 23:
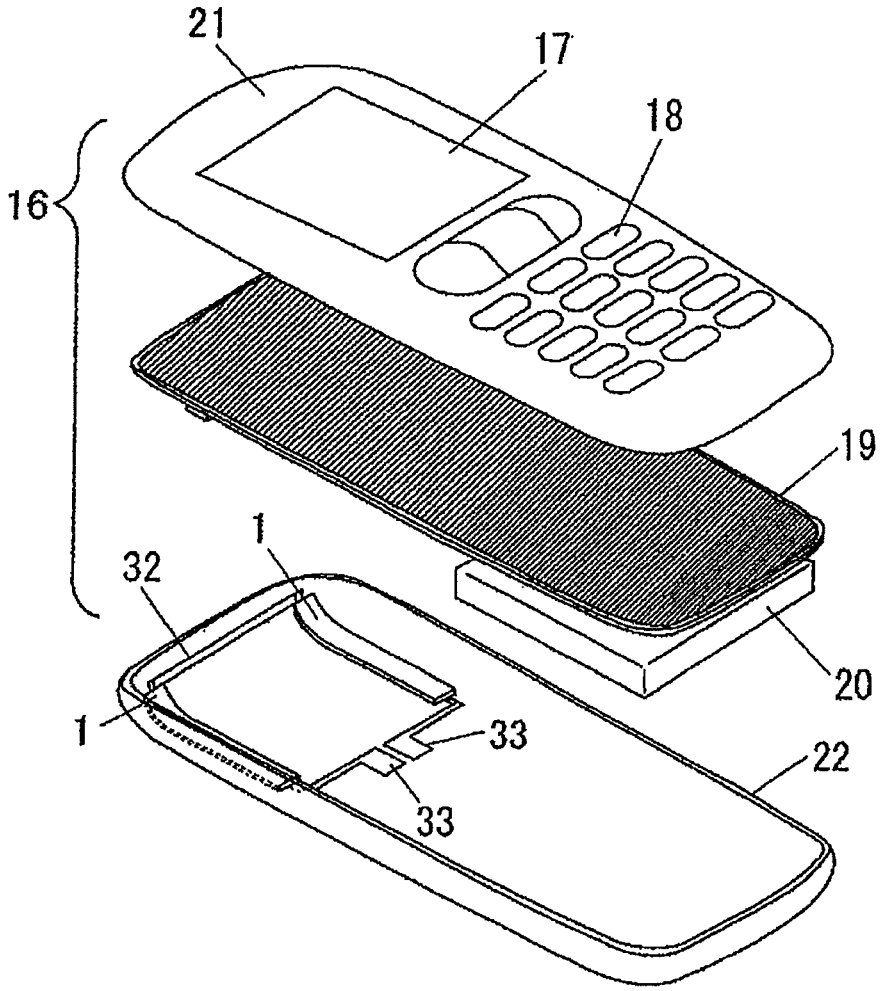
FIG. 23 is an exploded oblique perspective view of a portable terminal using the antenna of the embodiment of the present invention.

FIG. 23 is an exploded oblique perspective view of the portable terminal using the antenna of the embodiment of the present invention. The antenna 1 is provided on an interior surface of the enclosure 22. The substrate 19 or an unillustrated component to be mounted on the substrate 19 is utilized as a metallic element for the antenna 1. Even when the antenna 1 is not mounted directly on the metallic element, an antenna device exhibiting superior communication performance can be produced by adoption of the arrangement where a metallic element is located in the vicinity of the antenna 1 when the portable terminal is assembled. As above, in addition to being mounted on the metallic element, the antenna 1 can also be provided on the interior surface of the enclosure.

Detailed descriptions are now provided to a terminal structure.

The structure includes a magnetic substance made of a substantially rectangular parallelepiped; a coil around which the magnetic substance is wound and which has two ends; a first terminal that has first connection portions respectively provided in the vicinity of two corners located along one side of the magnetic substance and that has a joint for connecting the first connection portions provided along one side of the magnetic substance; and a second terminal that has second connection portions respectively provided in the vicinity of two corners located along a side of the magnetic substance opposing its one side and that has a joint for connecting the second connection portions and that is provided along the opposite side of the magnetic substance. One end of the coil is connected to any of the first connection portions, and the other end of the coil is connected to any of the second connection portions. It is thereby possible to produce an antenna unit whose coil does not require any excessive length and that is not limited in terms of directivity when mounted in a communication device.

The first connection portions and the second connection portions are arranged so as to act as fixing portions at the time of mounting of the antenna unit. The antenna unit can thereby be stably set in a communication device, or the like.

The structure also includes a magnetic substance made of a substantially rectangular parallelepiped; a coil around which the magnetic substance is wound and which has two ends; a first terminal that has first connection portions respectively provided in the vicinity of two corners located along one side of the magnetic substance and that has a joint for connecting the first connection portions provided along one side of the magnetic substance; and a second terminal that has second connection portions respectively provided in the vicinity of two corners located along a side of the magnetic substance opposing its one side and that has a joint for connecting the second connection portions and that is provided along the opposite side of the magnetic substance. One end of the coil is connected to one of the first connection portions, and the other end of the coil is connected to the other of the first connection portions. The first connection portions of the first terminal are disconnected. It is thereby possible to connect a line of the communication device, or the like, and a coil by use of any of the plurality of connection portions. In particular, it becomes possible to connect connection portions belonging to one terminal to a line of a communication device, or the like, whereby an antenna unit can be produced while directivity achieved when the antenna is mounted is further enhanced.

Figure 25:
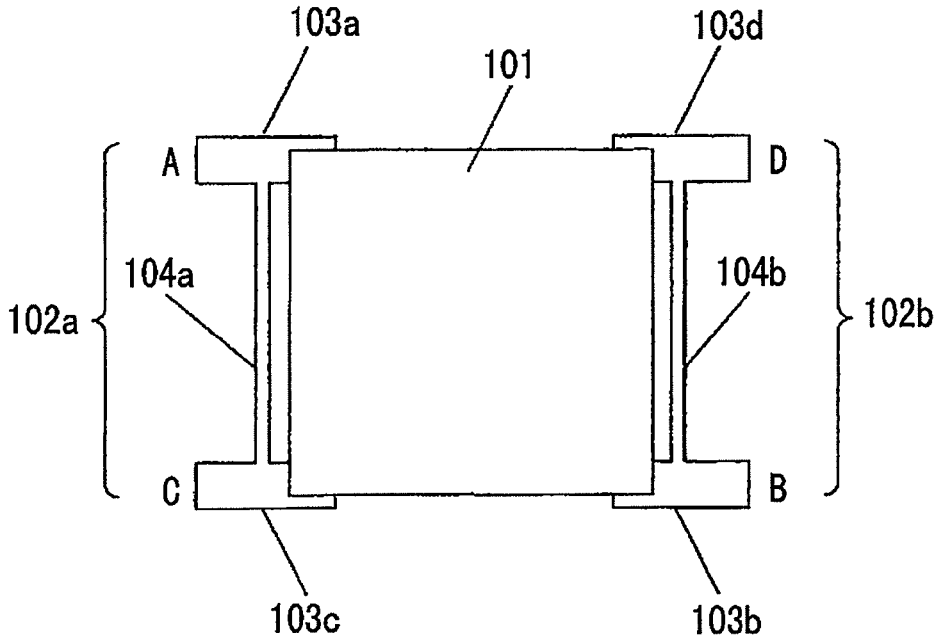
FIG. 25 is a rough schematic view of the antenna unit of the embodiment of the present invention.

FIG. 25 is a rough schematic view of the antenna unit of the embodiment of the present invention, showing a state of the antenna unit achieved before a coil is wound. Reference numeral 101 designates ferrite assuming the shape of a substantially rectangular parallelepiped. Reference numerals 102*a* and 102*b* designate terminal portions and connected to locations around four corners of the ferrite. The terminal portion 102*a* establishes an electrical connection between positions A and C, and the terminal portion 102*b* establishes an electrical connection between positions B and D. The terminal portion 102*a* includes a terminal 103*a* projecting outside from the ferrite 101 at the position A, a terminal 103*c* projecting outside from the ferrite 101 at the position C, and a rod-shaped joint 104*a* interconnecting the connection portions. The joint 104*a* is provided along one side of the ferrite 101. The terminal portion 102*b* also assumes the same structure as that of the terminal portion 102*a*. A joint 104*b* provided along another side of the ferrite 101 opposing the one side interconnects terminals 103*b* and 103*d*. The respective terminals 103*a* to 103*d* also exhibit functions of fixing the antenna unit to the communication device, or the like, when the antenna unit is mounted on the communication device, or the like.

Figure 26:
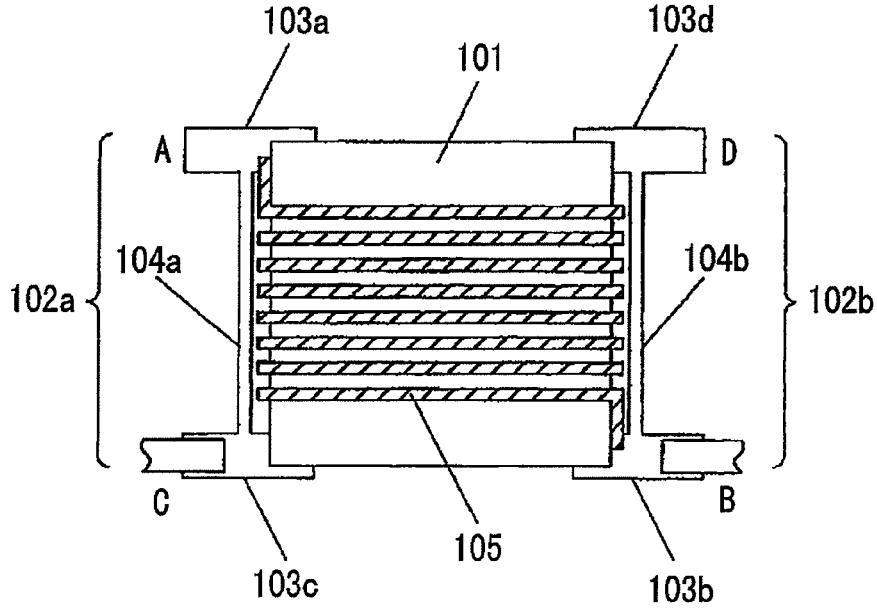
FIG. 26 is a rough schematic view of the antenna unit of the embodiment of the present invention.
Figure 27:
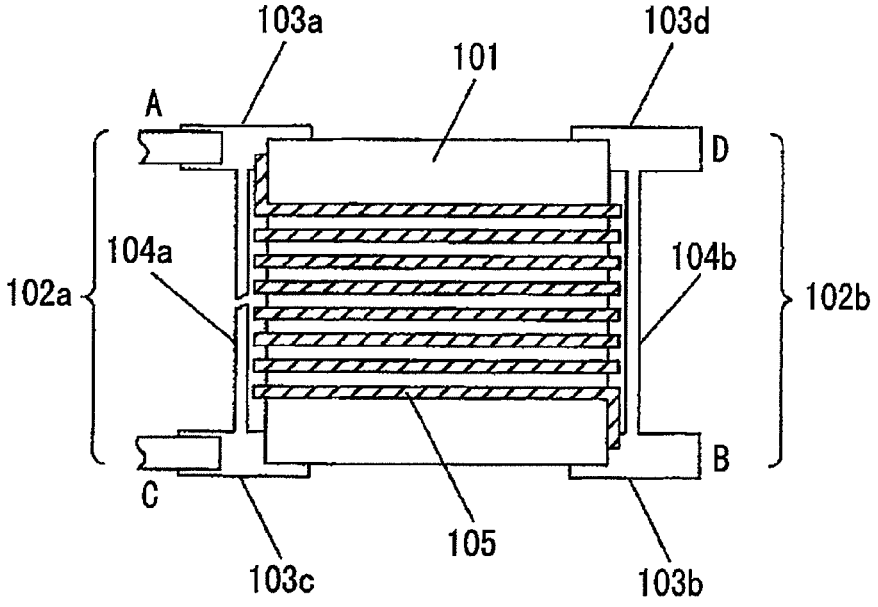
FIG. 27 is a rough schematic view of the antenna unit of the embodiment of the present invention.

FIGS. 26 and 27 are rough schematic views of the antenna units of the embodiment of the present invention, showing that a coil is wound around the antenna unit shown in FIG. 25. In FIG. 26, one end of the coil 105 is connected to the terminal 103*a* situated at the position A of the terminal portion 102*a*, and the other end of the coil 105 is connected to the terminal 103*b* situated at the position B of the terminal portion 102*b*. In the terminal portion 102*a*, the terminal 103*a* and the terminal 103*c* are joined together by means of the joint 104*a*, and the terminal 103*c* of the terminal portion 102*a* and the terminal 103*b* of the terminal portion 102*b* are held in an electrically conducted state by way of the coil 105. Accordingly, as shown in FIG. 26, even when the coil 105 is connected to the terminal 103*a* and the terminal 103*b*, respectively, the line of the communication device can be connected to the terminal 103 situated at the position C of the terminal portion 102*a* and the terminal 103*b* situated at the position B of the terminal portion 102*b*. In the case of the antenna unit shown in FIG. 26, one line of the communication device can be connected to the terminal 103*a* a situated at the position A of the terminal portion 102*a* or the terminal 103*c* situated at the position C of the terminal portion 102*a*. The other line can be connected to the terminal 103*b* located at the position B of the terminal portion 102*b* or the terminal 103*d* located at the position D of the terminal portion 102*b*. As a consequence, a degree of directivity freedom achieved when the antenna unit is mounted on the communication device can be enhanced.

FIG. 27 shows a case where the line of the communication device is connected solely to one terminal portion 102*a*. The coil 105 is connected to both the terminal 103*a* located at the position A of the terminal portion 102*a* and the terminal 103*c* located at the position C of the terminal portion 102*a*. In the meantime, the line of the communication device is also connected to both the terminal 103*a* and the terminal 103*c* of the terminal portion 102*a*. Provided that the terminal portion 102*a* remains in the state shown in FIG. 26, the terminal 103*a* and the terminal 103*c* are connected together, to thus be brought into electrical conduction. As mentioned above, when only a connection between the line of the communication device and only one terminal portion 102*a* is desired, all you have to do is to disconnect the joint 104*a* as shown in FIG. 27. So long as the joint 104*a* is disconnected, one side of the antenna device can be connected to the line of the communication device. The degree of directivity freedom achieved when the antenna unit is mounted on the communication device can be enhanced as in the case of the antenna unit shown in FIG. 26.

When actually mounted in a communication device, the antenna unit is used while the ferrite 101 and the terminal portions 102*a* and 102*b* are coated with a resin, or the like. On this occasion, only extremities of the respective terminals 103*a*, 103*b*, 103*c*, and 103*d* are exposed through the resin, and the thus-exposed extremities are connected to a line of the communication device.

As mentioned above, the antenna unit includes the base substrate 3; the coil 30 formed from the conductor 4 wound around the base substrate 3; and the plurality of terminals 5 connected to the conductor 4. The uncovered base substrate portions 31 where the conductor 4 is absent are formed on the base substrate 3 except the start and end of turns of the coil 30. The terminals 5 are provided on the end face side of the coil 30 parallel to the coil axis and in the uncovered base substrate portions 31. It is thereby possible to provide an antenna and an antenna unit, which enable space saving and which exhibit superior communication performance, and a communication device using them.

Further, it is preferable that the number of turns of the coil 30 of the antenna 1 is larger than an integral multiple by substantially one-half of turn, because the antenna can thereby efficiently utilize the electric current flowing over the metallic element on which the antenna is to be mounted.

Moreover, the uncovered base substrate portion 31 is formed on each end of the base substrate 3, whereby a magnetic field passing through an interior of the coil is made substantially parallel to the coil axis, so that an electric current can efficiently be guided.

The plurality of terminals 5 connected to the coil 30 are on the single uncovered base substrate portion 31. As a result, it is thereby possible to provide an antenna and an antenna unit, which enable space saving and which exhibit superior communication performance, and a communication device using them.

The terminals 5 each are placed at substantial four corners of the coil 30. The conductor 4 is connected to the terminals 5, among the four terminals 5, placed on both sides of the base substrate 3 with its coil axis interposed therebetween. It is thereby possible to provide an antenna and an antenna unit, which enable space saving and which exhibit superior communication performance, and a communication device using them.

An imaginary straight line passing through the two terminals 5 connected to the conductor 4 is substantially parallel to the winding direction of the coil 30. The magnetic field passing through the interior of the coil can thereby be made parallel to the coil axis, so that an electric current can efficiently be guided.

Moreover, the imaginary straight line passing through the two terminals 5 connected to the conductor 4 is substantially parallel to a diagonal line of the base substrate 3. As a result, it is thereby possible to acquire an antenna unit that enables efficient utilization of the electric current flowing over the metallic element and that exhibits superior communication performance.

The plurality of terminals 5 connected to the conductor 4 are placed on both sides of the base substrate 3 with its coil axis interposed therebetween. The imaginary straight line passing through the two terminals 5 connected to the conductor 4 is substantially parallel to the winding direction of the coil 30. As a result, it is thereby possible to acquire an antenna unit that enables efficient utilization of the electric current flowing over the metallic element and that exhibits superior communication performance.

Furthermore, the plurality of terminals 5 connected to the conductor 4 are arranged on both sides of the base substrate 3 with the coil axis interposed therebetween. The imaginary straight line passing through the two terminals 5 connected to the conductor 4 is substantially parallel to the diagonal line of the base substrate 3. As a result, it is thereby possible to acquire an antenna unit that enables efficient utilization of the electric current flowing over the metallic element and that exhibits superior communication performance.

The antenna is mounted such that at least one of the uncovered base substrate portions provided on the antenna is situated outside of the outer periphery of the metallic element on which the antenna is mounted. As a result, it is thereby possible to acquire an antenna unit that enables efficient utilization of the electric current flowing over the metallic element and that exhibits superior communication performance.

It is also preferable that the coil 30 is arranged in such a way that the winding direction of the coil and the ends of the base substrate 7 that is a metallic element become parallel to each other, become the electric current flowing over the metallic element on which the antenna is mounted can thereby be efficiently utilized.

It is also preferable that the coil 30 is arranged in such a way that the winding direction of the coil and the flow of the electric current flowing through the metallic element become parallel to each other, because the electric current flowing over the metallic element on which the antenna is mounted can thereby be efficiently utilized.

The plurality of terminals 5 each are placed at substantially four corners of the coil 30. Of the four terminals 5, two pairs of terminals 5, each of which consists of two terminals 5 placed in the vicinity of the two corners situated along one side of the base substrate 3, each are joined together by means of the joints 104 provided along the respective sides of the base substrate 3. It is thereby possible to acquire an antenna unit that does not require an excessive length for the coil and that is not limited in terms of directivity when mounted on the communication device.

The terminals 5 act as fixing portions when the antenna unit is mounted, whereby the antenna unit can stably be placed in a communication device, or the like.

The joints 104 extend substantially parallel to the coil axis of the base substrate 3. It is thereby possible to easily acquire an antenna unit that does not require an excessive length for the coil and that is not limited in terms of directivity when mounted on a communication device.

According to the antenna and the antenna unit of the present invention, the antenna unit can be made by utilization of clearance between components in the enclosures. Therefore, space saving of the antenna unit becomes possible, which is useful for miniaturization of the enclosures. For instance, the antenna and the antenna unit can be utilized as; an RF-ID antenna (tag) of a portable phone.

The disclosure of Japanese Patent Application No. 2009-197844 filed Aug. 28, 2010, including specification, drawings and claims is incorporated herein by reference in its entirety.

What is claimed is:

1. An antenna, comprising:

a base substrate;

a coil formed from a conductor wound around the base substrate; and a plurality of terminals connected to the conductor, wherein a base substrate portion where the conductor is absent is formed on the base substrate except a start and end of turns of the coil, the plurality of terminals are provided on respective sides of the coil, the respective sides of the coil being parallel to a coil axis, the plurality of terminals are not in physical contact with the base substrate, the plurality of terminals are located in areas adjacent to the base substrate portion where the conductor is absent and extend in an outward direction from the respective sides of the coil being parallel to the coil axis, the plurality of terminals does not overlap with an interior area which is substantially perpendicular to the coil axis of the coil and which is surrounded by the conductor of the coil, wherein the base substrate has edge faces that intersect with the coil axis; and wherein a conductive body is not provided on each of the edge faces, wherein each of a terminal of the plurality of terminals is provided substantially at four corners of the coil, and the conductor is connected to two terminals of the plurality of terminals, the conductor being located among the plurality of terminals, which are placed on both sides of the base substrate with a coil axis interposed therebetween.

2. The antenna according to claim 1, wherein number of turns of the coil of the antenna is larger than an integral multiple by substantially one-half of the turn.

3. The antenna according to claim 1, wherein the base substrate portion is formed on each end of the base substrate.

4. The antenna according to claim 1, wherein the plurality of terminals that are connected to the coil are on a single base substrate portion.

5. The antenna according to claim 1, wherein an imaginary straight line passing through two terminals connected to the conductor is substantially parallel to a winding direction of the coil.

6. The antenna according to claim 1, wherein an imaginary straight line passing through two terminals connected to the conductor is substantially parallel to a diagonal line of the base substrate.

7. The antenna according to claim 1, wherein the plurality of terminals connected to the conductor are placed on both sides of the base substrate with a coil axis interposed therebetween, and an imaginary straight line passing through the plurality of terminals connected to the conductor is substantially parallel to a winding direction of the coil, wherein the winding direction is substantially perpendicular to the coil axis.

8. The antenna according to claim 1, wherein the plurality of terminals connected to the conductor are placed on both sides of the base substrate with a coil axis interposed therebetween, and an imaginary straight line passing through the plurality of terminals connected to the conductor is substantially parallel to a diagonal line of the base substrate.

9. An antenna unit, comprising:

a base substrate;

a metallic element on which the base substrate is mounted;

a coil formed from a conductor wound around the base substrate; and a plurality of terminals connected to the conductor, wherein a base substrate portion where the conductor is absent is formed on the base substrate except a start and end of turns of the coil, the plurality of terminals are provided on respective sides of the coil, the respective sides of the coil being parallel to a coil axis, the plurality of terminals are not in physical contact with the base substrate, the plurality of terminals are located in areas adjacent to the base substrate portion where the conductor is absent and extend in an outward direction from the respective sides of the coil being parallel to the coil axis, the base substrate portion is situated outside of an outer periphery of the metallic element, and the plurality of terminals does not overlap with an interior area which is substantially perpendicular to the coil axis of the coil and which is surrounded by the conductor of the coil, wherein the base substrate has edge faces that intersect with the coil axis; and wherein a conductive body is not provided on each of the edge faces, wherein a plurality of terminals each are provided substantially at four corners of the coil.

10. The antenna unit according to claim 9, wherein a winding direction of the coil is parallel to ends of the metallic element.

11. The antenna unit according to claim 9, wherein a winding direction of the coil is parallel to flow of an electric current running over the metallic element.

12. The antenna unit according to claim 9, wherein the plurality of terminals act as fixing portions when the antenna unit is mounted.

13. The antenna unit according to claim 9, wherein joints extend substantially parallel to the coil axis of the base substrate.

14. The antenna according to claim 1, wherein a start and end of the coil extends along side edges of the base substrate.

15. The antenna according to claim 1, wherein the plurality of terminals are located near corners of the base substrate.

* * * * *